United States Patent [19]

Kryter

[11] Patent Number: 4,720,109

[45] Date of Patent: Jan. 19, 1988

[54] GOLF CLUB WITH STROKE GUIDING DEVICE

[75] Inventor: Karl D. Kryter, Bodega Bay, Calif.

[73] Assignee: Acousis Company, Bodega Bay, Calif.

[21] Appl. No.: 923,182

[22] Filed: Oct. 27, 1986

[51] Int. Cl.[4] ..... A63B 69/36

[52] U.S. Cl. ..... 273/164; 273/194 A

[58] Field of Search ..... 273/194 A, 168, 186 A, 273/162 E, 163 R, 163 A, 164

[56] References Cited

U.S. PATENT DOCUMENTS

| | | | |
|---|---|---|---|
| D. 111,855 | 10/1938 | Moreno . | |
| D. 150,497 | 8/1948 | Forsell | D34/5 |
| D. 188,677 | 8/1960 | Thornson | D34/5 |
| 2,670,209 | 2/1954 | Fay | 273/163 |
| 2,898,109 | 8/1959 | Williams | 273/163 |
| 3,033,574 | 5/1962 | Partridge | 273/163 |
| 3,039,776 | 6/1962 | Faini | 273/194 A X |
| 3,194,564 | 7/1965 | Swan | 273/194 A X |
| 3,198,525 | 8/1965 | Smith | 273/163 |
| 3,292,928 | 12/1966 | Billen | 273/163 |
| 3,298,693 | 1/1967 | Eisenberg | 273/163 |
| 3,384,376 | 5/1968 | Greenlee | 273/194 A |
| 3,489,415 | 1/1970 | Smith | 273/186 |
| 3,529,830 | 9/1970 | Palotsee | 273/163 |
| 3,667,761 | 6/1972 | Palotsee | 273/186 A |
| 3,866,922 | 2/1975 | Marci et al. | 273/164 |
| 3,921,984 | 11/1975 | Winter | 273/164 |
| 3,951,415 | 4/1976 | Stuart | 273/183 D |
| 3,979,125 | 9/1976 | Lancellotti | 273/194 A X |
| 4,002,343 | 1/1977 | Eckert | 273/163 R |
| 4,025,078 | 5/1977 | Pelz | 273/186 A |
| 4,053,160 | 10/1977 | Salata | 273/186 A |
| 4,130,282 | 12/1978 | Pelz | 273/186 A |
| 4,167,268 | 9/1979 | Lorang | 273/163 A |
| 4,323,246 | 4/1982 | Nehrbas | 273/186 A |
| 4,383,690 | 5/1983 | Maxwell | 273/168 X |

FOREIGN PATENT DOCUMENTS

| | | | |
|---|---|---|---|
| 313699 | 6/1929 | United Kingdom | 273/164 |

*Primary Examiner*—George J. Marlo

*Attorney, Agent, or Firm*—Victor R. Beckman

[57] ABSTRACT

Guide means for a golf club is shown that includes a pair of visible line segments that are parallel, generally V-shaped, and/or X-shaped. At least portions of the line segments extend forwardly of the ball-striking surface of the club head. The parallel line segments are located at opposite ends of the club head, at opposite sides of, and equal distances from, a vertical plane that is normal to the ball-striking surface of the head at the sweet-spot thereof. The V-shape guide lines converge at said vertical plane and the X-shaped guide lines intersect at said vertical plane. The guide lines are substantially horizontally positioned at a height above the bottom surface of the club head that is greater than the diameter of a golf ball to allow striking of a golf ball by the striking surface.

21 Claims, 10 Drawing Figures

GOLF CLUB WITH STROKE GUIDING DEVICE

FIELD OF THE INVENTION

This invention relates to guide means which may be made a part of, or attached to, a golf club that enhances the ability of the player to develop and use a club stroke such that the sweet spot of the striking surface of the club blade and the orientation of the blade cause the ball to follow an intended path line when struck.

BACKGROUND OF THE INVENTION

Aids for improving a player's golf stroke are well known. One type of aid includes an arrow-type pointer for use in pointing the club head in the direction of the hole. Typical aids of this type are shown in U.S. Pat. Nos. 3,033,574; 3,198,525; 3,298,693; 3,292,928; 3,529,830; 3,667,761; 4,053,160; Des. 111,855; Des. 150,497; and Des. 188,677. In other arrangements the arrow-type pointer is included in a structure which includes an opening through which the golf ball is viewed when the club engages the ball. U.S. Pat. Nos. 2,670,209 and 4,002,343 show aids of this type.

Sighting devices which attach to the club shaft a spaced distance from the club head are shown in U.S. Pat. Nos. 2,898,109; 3,951,415 and 4,167,268. Finally, devices which attach to the club face are shown in U.S. Pat. Nos. 3,489,415; 4,025,078; 4,130,282 and 4,323,246. Many prior art guides do not readily provide cognitive information relative to the exact lateral location of the sweet-spot on the striking surface of the club head, and the club orientation, prior to, at the moment of, and following impact of the head of the club with the ball.

OBJECTS AND SUMMARY OF THE INVENTION

An object of this invention is the provision of improved guide means which is attached to a golf club to aid the golfer in properly stroking the ball.

An object of this invention is the provision of guide means of the above-mentioned type that include relatively unintrusive line segments which provide stroke-guidance information when brought into the visual field occupied by the golf ball.

The above and other objects and advantages of this invention are achieved by guide means attached to the club and comprising a pair of visible line segments which form a V-shape. At least parts of the V-shaped guide means are located ahead of the striking surface of the club, with the point of the V-shape located on a vertical plane that is normal to the striking surface of the club and extending through the sweet-spot of the blade of the club. The line segments extend forwardly from the point of the V-shape and obliquely transversely relative to the striking surface of the club. The guide means are positioned at a height above the bottom surface of the club blade that is greater than the diameter of the golf ball, such that the forward parts of the V-shape are higher than the top of the golf ball when the ball engages the sweet-spot of the blade of the club. Instead of a V-shape, the guide means may be of an X-shape, comprising a pair of intersecting line segments. The point of intersection of the X-shaped line segments is located at the same place as the point of the V-shape guide means. The guide means may be supported on brackets equally spaced laterally from said vertical plane that is normal to the sweet-spot of the blade of the club. The brackets may comprise, or may be provided with visible line segments that extend parallel to said plane to provide further visual guidance to the golfer.

BRIEF DESCRIPTION OF THE DRAWINGS

The invention, together with other objects and advantages thereof, will be better understood from the following description when considered with the accompanying drawings. In the drawings, wherein like reference characters refer to the same parts in the several views.

Figure 1:
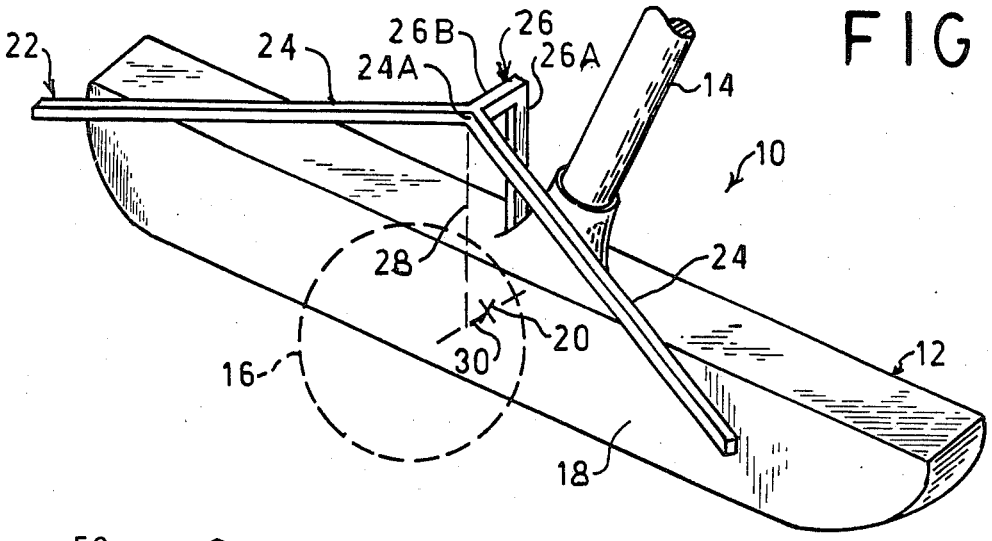
FIG. 1 is a fragmentary perspective view of a golf club showing guide means having a generally V-shape attached thereto, which guide means embodies the present invention.

Reference first is made to FIG. 1 wherein there is shown a golf club 10 which includes a club head, or blade, 12 and shaft 14. Although, for purposes of illustration, a putter is shown, it will be understood that the guide means of this invention may be used with other golf clubs. A golf ball 16 is shown in broken lines adjacent the striking surface 18 of the club head. Reference numeral 20 identifies the sweet-spot on the striking surface of the club head; the location of the sweet-spot being identified by the letter X on the striking surface. Sweet-spot 20 identifies the exact balance-point of the club head, at which point ball 16 is best to be struck if an accurate shot is to be made. Putters may be provided with a marker or markers on the top surface of the head behind the location of the sweet-spot.

Novel guide means 22 embodying the present invention are attached to the club, which guide means comprise a pair of line segments 24,24 which form a V-shape. The illustrated line segments comprise slender, elongated, members which may be formed of metal, plastic, fibrous materials, or the like. A bracket 26 attaches the line segments to the golf club which, in the illustrated arrangement, comprises an inverted L-shaped member that includes a vertical section 26A and a horizontal section 26B extending forwardly from the vertical section. The bottom of bracket section 26A is secured to the club head by any suitable means. Line segments 24,24 are attached to the forward end of horizontal bracket section 26B at the point 24A of the V-shape guide means. Point 24A is located in a vertical plane that is normal to the striking surface 18 of the club head at the sweet-spot 20, which plane bisects the V-shaped angle formed by visual line segments 24,24. In FIG. 1, broken line 28 is shown extending vertically downward from point 24A, and broken horizontal line 30 is shown extending forwardly and rearwardly from the sweet-spot 20, which lines lie in, and define, the vertical plane that is normal to the striking surface 18 and extending through the sweet-spot 20.

From the above, it will be seen that point 24A of the V-shaped guide means is located on a plane that is normal to the striking surface 18 and that extends through the sweet-spot 20. The point 24A may be located forwardly, rearwardly, or on the plane of the ball striking surface 18 and for purposes of illustration, but not by way of limitation, it is shown located forwardly of the plane of ball striking surface 18. Each line segment 24 extends forwardly from and obliquely transverse relative to the striking surface 18 and, as noted above, they extend in different directions laterally from a point on the vertical plane that is normal to the striking surface 18 and extends through the sweet-spot 20. The line segments 24,24 are positioned by bracket 26 above the bottom ground-facing surface of the club head at a height that is greater than the diameter of golf ball 16.

When initiating a golf shot, a golfer visualizes a direction line it is wished the ball to follow after being struck by the blade of the club. It is important for accuracy that the ball be struck on the sweet-spot of the club face. Otherwise, the ball will tend to be pushed or pulled, somewhat from the direction line intended for the ball, and may not travel as far as it otherwise would. The present invention permits the golfer to concentrate his or her focus on the ball lying on the ground and, at the same time brings into the visual field occupied by the golf ball, thin, relatively unobtrusive, line segments 24,24 that converge symmetrically toward the golf ball when the sweet-spot of the club head is exactly in line with the ball as the club head approaches the ball. Visual line segments 24,24 are of substantially the same length and terminate at the forward ends the same distance forward from the plane of striking surface 18. The V-shaped guide means not only provides a guide for striking the ball at the sweet-spot, but also provides advanced information concerning the relative angle between the striking face 18 of the club and the path through which the club head is swung. If the front end of one line segment extends further forward than the front end of the other line segment, it is known that the striking face 18 is not normal to the path along which it is desired to propel the ball 16, and correction is possible before the ball is struck. That is, the plane that bisects the V-shaped visual line segments 24,24 defined by lines 28 and 30 in FIG. 1, should lie in the desired path of the ball 16 and, if it does not, this fact is made readily apparent to the golfer simply by observing the difference in angles that the two line segments make with the desired path.

Figure 2:
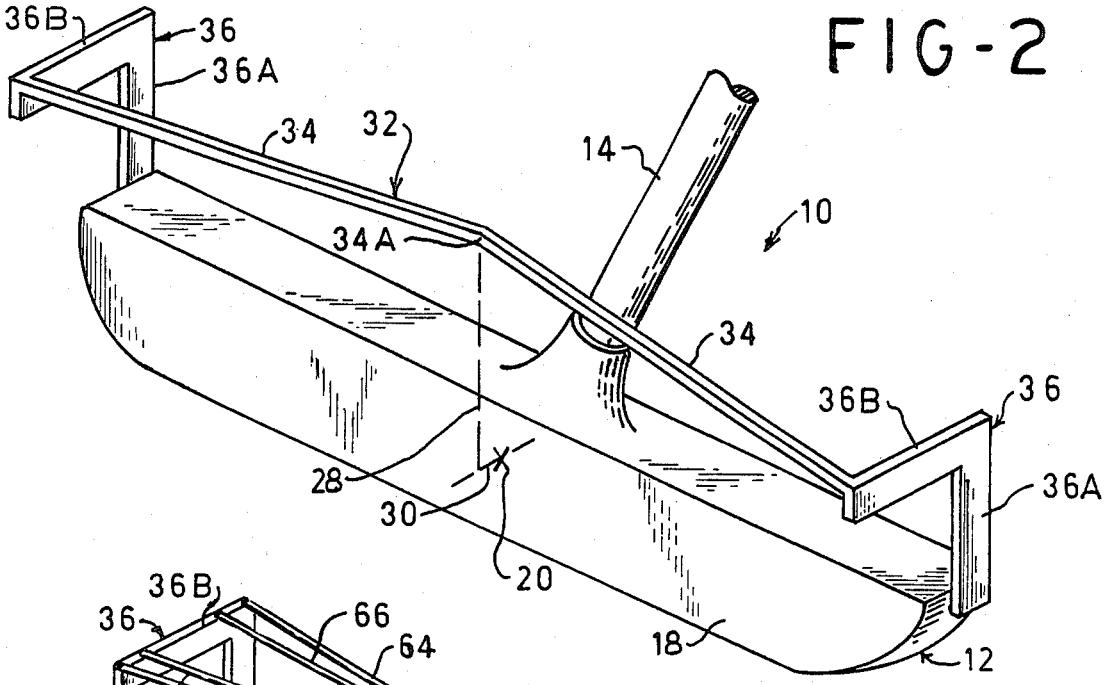
FIG. 2 is a fragmentary perspective view of a golf club and showing a modified form of V-shaped guide means attached to the club.

Reference now is made to FIG. 2 wherein a modified form of guide member is shown identified by reference numeral 32 that includes a pair of visual line segments 34,34 which form a V-shape. As with the arrangement of FIG. 1, the line segments 34,34 comprise relatively unobtrusive slender, elongated members that converge at point 34A located in a vertical plane that is normal to the striking surface 18 of the club head 12 and extending through the sweet-spot 20. The line segments 34,34 are supported at the outer free ends thereof by brackets 36,36 attached to the club head at the opposite ends thereof. Each bracket includes a vertical upright section 36A and a forwardly extending horizontal section 36B. As with the arrangement of FIG. 1, the V-shaped line segments 34,34 function to aid the golfer in striking the golf ball at the sweet-spot and at the same time provide advanced information concerning the angle between the striking surface 18 of the club head and the desired line of travel of the golf ball.

As viewed from above, horizontal sections 36B of brackets 36,36 comprise visual line segments at opposite ends of the club head that are equi-distant from the sweet-spot 20 and extend forwardly of the striking face 18. In the illustrated arrangement, line segments 36B, 36B are parallel to each other and to the plane identified by lines 28 and 30. These line segments also provide stroke guidance information to the golfer. Line segments 36B, 36B need not extend parallel to each other but, instead, may be positioned along converging lines, with the angle between the line segment extended and the vertical plane through the sweet-spot being the same for both line segments.

Figure 3:
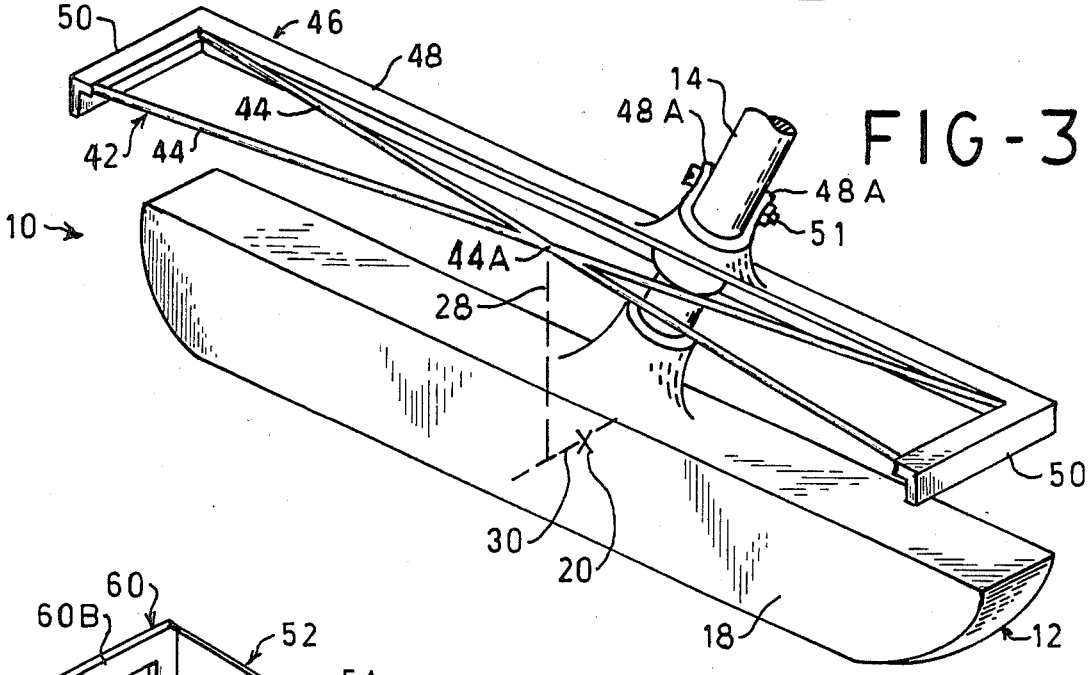
FIG. 3 is a fragmentary perspective view of a golf club showing a modified form of guide means which is of a generally X-shape.

If desired, V-shaped line segments such as line segments 24,24 of FIG. 1 and line segment 34,34 of FIG. 2 may be extended rearwardly from the point of convergence thereof to provide for generally X-shaped visual guide means. Referring to FIG. 3, an X-shaped guide member 42 is shown comprising a pair of intersecting line segments 44,44. It here will be noted that portions of the line segments forward of the point 44A at which they intersect correspond, essentially, to the V-shaped guide means 32 shown in FIG. 2. Support for X-shaped guide means 42 on the golf club is provided by a U-shaped bracket 46 comprising a transverse member 48 and a pair of forwardly-extending arms 50,50 at opposite ends thereof, which arms are located equal distances from the vertical plane containing lines 28 and 30 and sweet-spot 20 at the striking surface 18. Transverse arm 48 is formed with a pair of laterally spaced arcuate legs 48A,48A for removably gripping shaft 14 of the golf club. A threaded fastener 51 extends through apertures at the free ends of legs 48A,48A for securely clamping guide means 46 to the golf club.

Line segments 44, 44 extend from the forward ends of arms 50,50 obliquely transversely to the rear ends thereof. They may comprise rigid members, such as line segments 24,24 and 34, 34 of the FIG. 1 and FIG. 2 embodiments, or they may comprise strings, or wires, since they are anchored at their opposite ends. The point 44A of intersection of line segments 44,44, is located in a vertical plane that is normal to the striking surface 18 of the club head 12 and extending through the sweet-spot 20. Again, vertical and horizontal lines 28 and 30 in FIG. 3 define such a plane. Portions of line segments 44,44 located rearwardly of intersection point 44A provide the golfer with additional visual information concerning the orientation of the striking surface 18 relative to the path of travel of the club head. If the striking surface is not normal to said path, this fact is readily noted by observation of the line segments 44,44 of guide means 42. Also, as with the FIG. 2 arrangement, line segments provided by horizontal arms 50,50 at opposite sides of the sweet-spot 20 provide the golfer with additional visual information concerning the orientation of the club head relative to the path of travel thereof.

Figure 4:
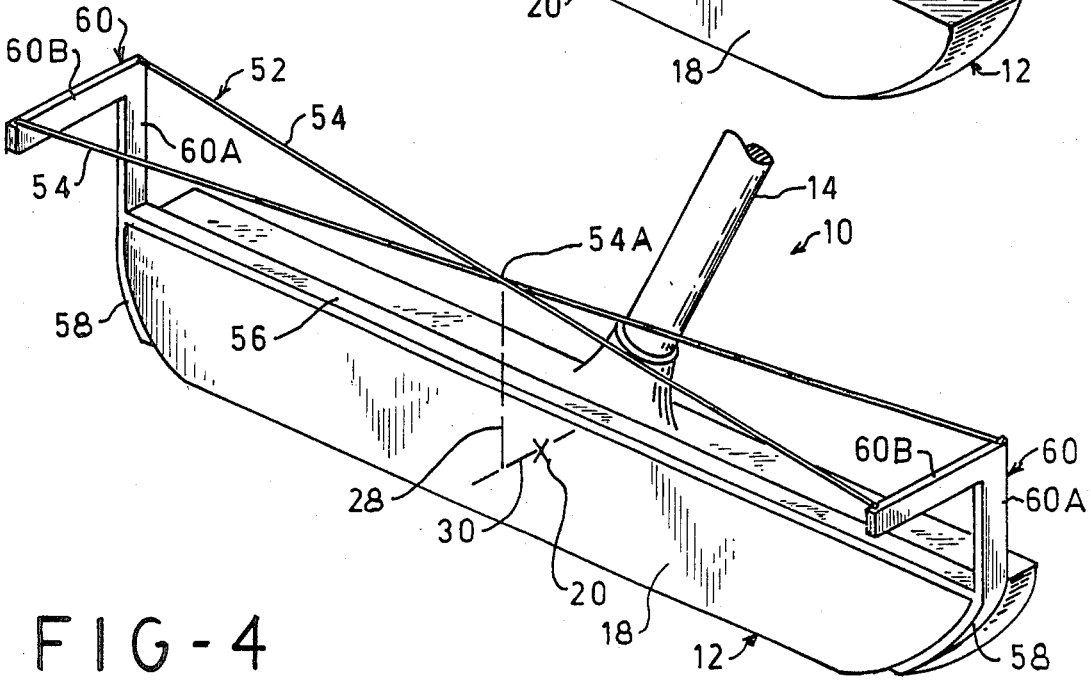
FIG. 4 is a fragmentary perspective view of a golf club showing a modified form of X-shaped guide means attached thereto.

Reference now is made to FIG. 4 that shows a guide means 52 which includes a pair of intersecting line segments 54,54 in an X-shape form, similar to that of FIG. 3. Guide means 52 is removably attached to the club head 12 rather than to the club shaft 14. It includes a transverse web 56 having downwardly extending arcuate legs 58,58 at opposite ends thereof. Web 56 engages the upper surface of the club head, and the arcuate legs 58,58 engage the ends of the club head and extend for a short distance along the bottom surface thereof. The guide means may be made of rigid, yet slightly resilient material so as to firmly grip the club head when attached thereto.

Brackets 60,60 are provided at opposite ends of the web 56, each of which includes an upwardly-directed arm 60A and forwardly-directed arm 60B at the upper end of arm 60A. The intersecting line segments 54,54 are attached to the arms 60B, 60B, with the point of intersection 54A located in a vertical plane normal to the striking surface 18 and extending through the sweet-spot 20. Also, as in other arrangements, horizontal arms 60B, 60B may comprise visual line segments for aiding the golfer's swing.

Figure 5:
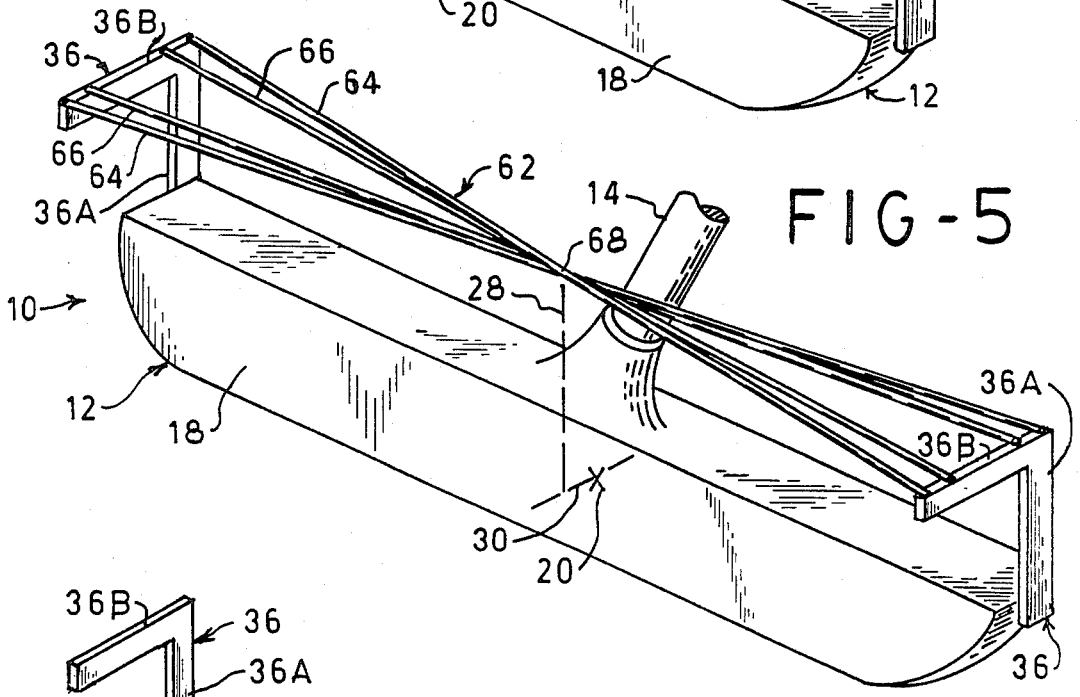
FIG. 5 is a fragmentary view of a golf club showing another modified form of X-shaped guide means which includes a plurality of X-shaped line segments.

If desired, the guide means of this invention may include a plurality of V-shaped, or X-shaped, line segments, which converge, or intersect, in the vertical plane which is normal to the striking surface and passes through the sweet-spot thereon. One such arrangement is shown in FIG. 5 wherein the head 12 of golf club 10 is shown provided with inverted L-shaped brackets 36,36 of the same type shown in FIG. 2 and described above. Guide means 62 in the form of first and second pairs of intersecting line segments 64,64 and 66,66, respectively, are attached to the horizontal arm portions 36B, 36B of brackets 36,36. The X-shape formed by line segments 66,66 is located inside that formed by line segments 64,64, and all of the line segments intersect at point 68 which is located in a plane normal to the striking surface and extending through sweet-spot 20. Line segments 66,66 inside line segments 64,64 provide additional visual guidance to the golfer. As in other arrangements wherein the line segments are supported at opposite ends, they may comprise wire, flexible lines, or the like that extend between brackets 36, rather than rigid segments.

Figure 6:
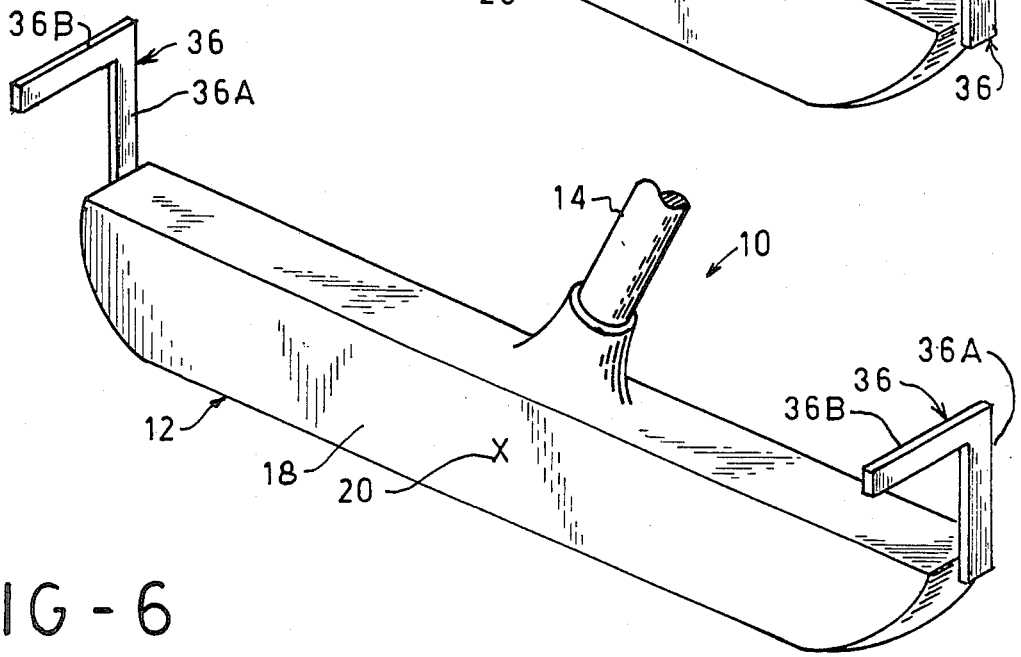
FIG. 6 is a fragmentary view of a golf club showing the use of guide means comprising a pair of parallel visual line segments laterally spaced from the sweet-spot of the club but without V-shaped or X-shaped line segments of the type shown in FIGS. 1–5.

As noted above, horizontal arm membrs, such as arm numbers 36B,36B of FIGS. 2 and 5 comprise visible line segments for guidance of the club. If desired, the golf club may be provided with such visible guide means without the V-shaped or X-shaped line segments extending therethrough. Such an arrangement is shown in FIG. 6. In the illustrated arrangement, line segments 36B,36B extend parallel to each other and normal to the striking face 18. They are equi-distance from the sweet-spot at opposite ends of the club head 12. If desired, they may extend obliquely laterally outwardly from the upright arms 36A,36A to form a funnel shape as viewed from above by the golfer.

Figure 7:
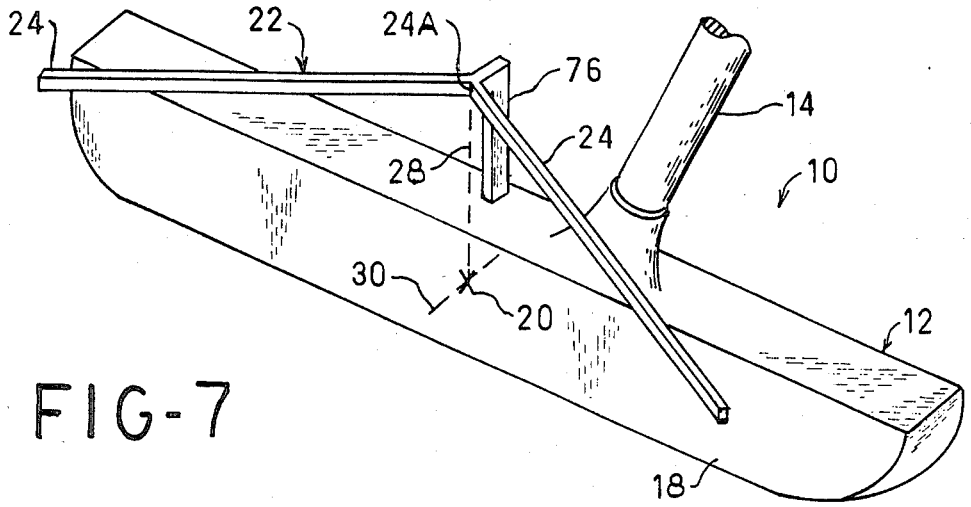

As noted above, the point of the V-shaped guide means may be located forwardly, rearwardly, or on the plane of the ball striking surface 18. In FIG. 7, to which figure reference now is made, the point of the V-shaped guide means is shown located in the plane of the ball striking surface 18. Guide means 22 of the same type as shown in FIG. 1 is employed in the FIG. 7 arrangement, which guide means includes line segments 24,24 which form a V-shape. An inverted L-shaped bracket 76 attaches the line segments to the club head such that the point 24A of the V-shaped guide means is located directly above sweet-spot 20. In FIG. 7, broken line 28 which extends vertically downwardly from point 24A is seen to intersect horizontal broken line 30 at the sweet-spot 20.

Figure 8:
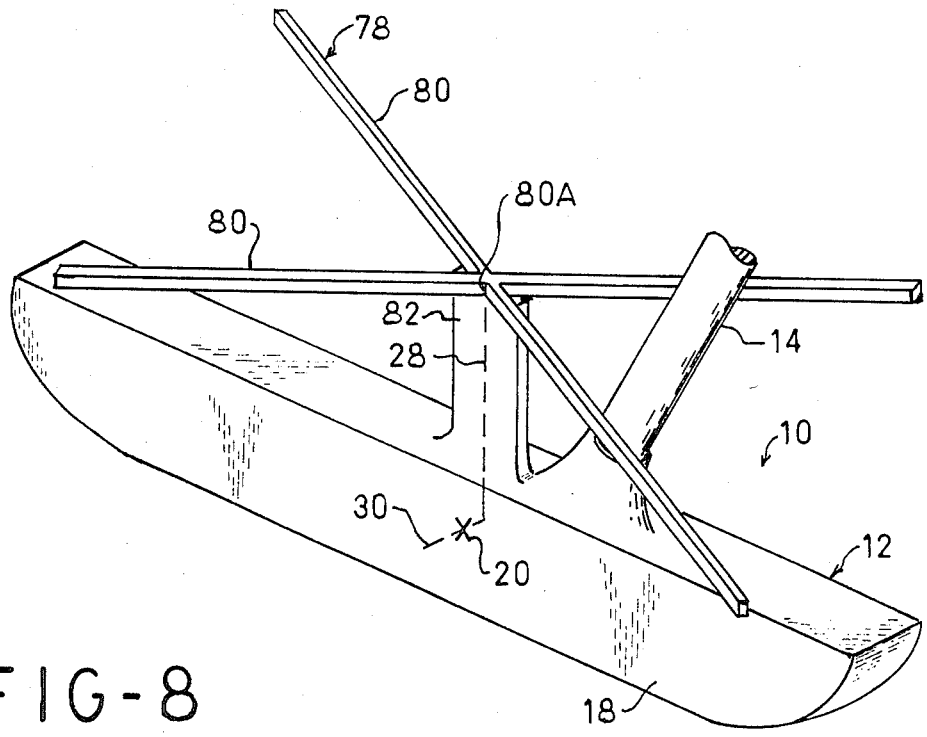

In FIG. 8, to which reference now is made, an X-shaped guide means 78 is shown comprising a pair of intersecting line segments 80,80, which intersect at point 80A. Support of the guide means is provided by a bracket 82 extending upwardly from the top of the golf club 10. The point 80A of intersection of line segments 80,80 is located in a vertical plane that is normal to the striking surface 18 of the club head 12 and extending through the sweet-spot 20. As above, vertical and horizontal lines 28 and 30 define such a plane. As seen in FIG. 8, point 80A is located rearwardly of the plane of the ball striking surface 18. Major portions of the forwardly extending line segments extend forwardly of the plane of the ball striking surface to provide the golfer with advanced information concerning the angle between the ball striking surface and the desired line of travel of the golf ball. It will be noted that major portions of the rearwardly extending line segments (i.e. the line segments that extend rearwardly from point 80A) extending rearwardly of the plane of the rear of the club head. If desired, the rear of the club may be provided with a ball striking surface to permit both right and left hand use of the club.

Figure 9:
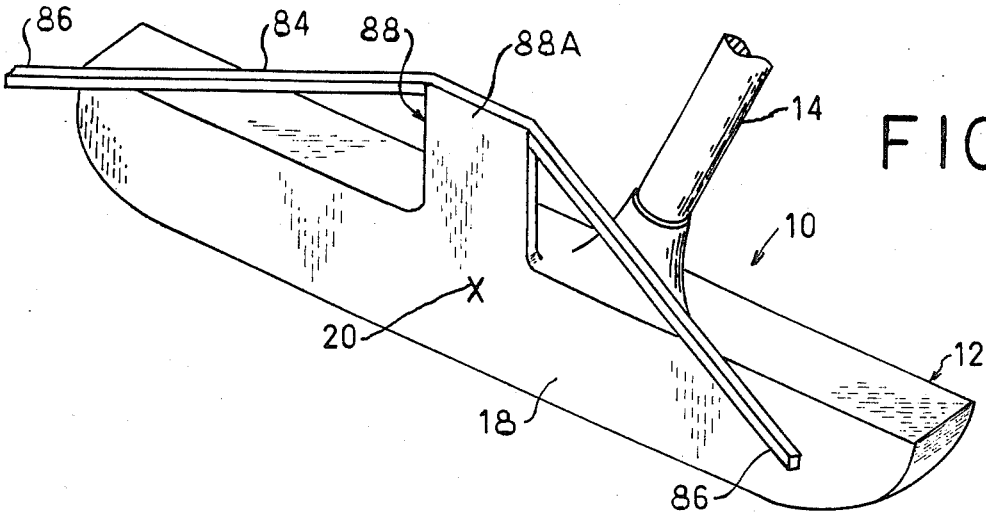

If desired, the point of convergence of the V-shape or X-shape guide means may be truncated to some degree without materially reducing the affectiveness of the guide means. Reference is made to FIG. 9 wherein guide means 84 is shown comprising line segments 86,86 carried by bracket 88 attached to the club head 12. In the illustrated arrangement, the front face 88A of bracket 88 lies in the plane of the ball striking surface 18, and line segments 86,86 extend forwardly from and obliquely transverse relative to the plane of the ball striking surface. The top surface of bracket 88 together with the line segments 86,86 provide for a generally truncated V-shaped visual guide means. Again, the line segments 86,86 provide the golfer with advanced information concerning the angle between the ball striking surface and the desired line of travel of the golf ball.

Figure 10:
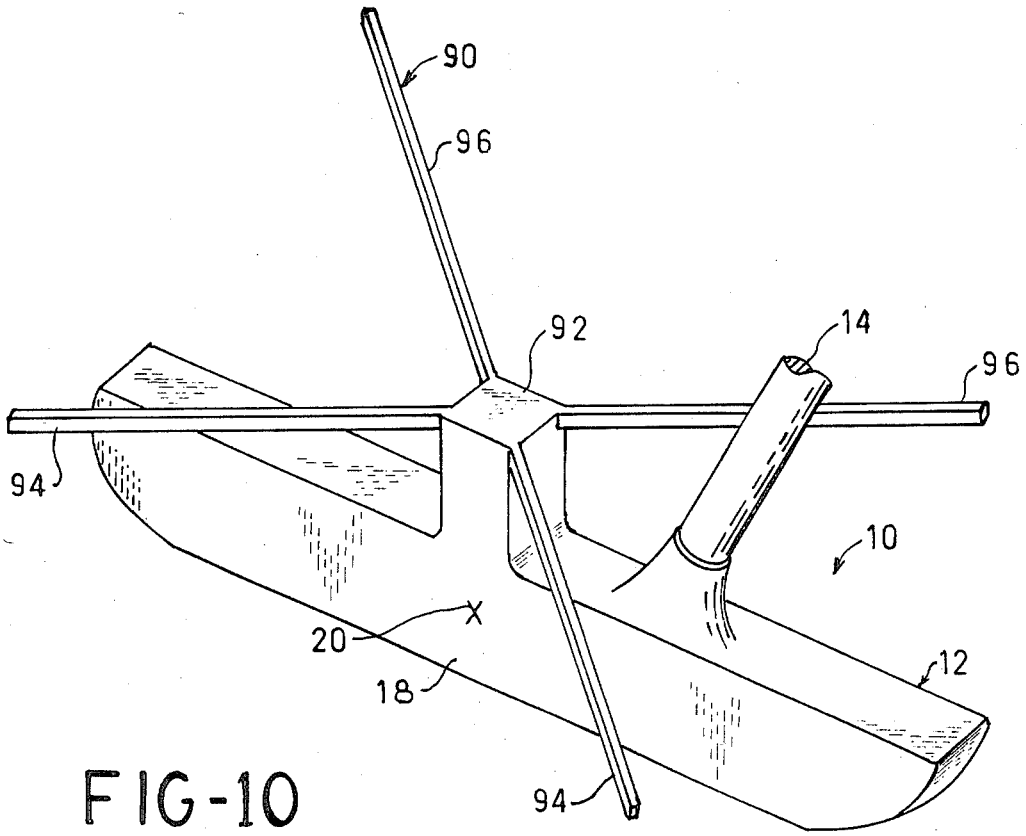

Reference now is made to FIG. 10 wherein a generally X-shaped guide means 90 is shown attached to club head 12 by an upwardly extending bracket 92. Guide means 90 includes forwardly extending line segments 94,94 and rearwardly extending line segments 96,96 which extend from the corners of the bracket 92. The forwardly extending line segments 94,94 correspond to line segments 86,86 of FIG. 9 arrangement, and provide the golfer with advance information concerning the golf stroke. Also, as with the FIG. 8 arrangement, the rear of the club head may be provided with a golf-striking surface thereby adapting the club for either right or left hand use.

It here will be noted that at least a portion of a golf ball at the sweet-spot of the ball-striking surface is visible between the forwardly extending visible line segments of the guide means of this invention.

From the above it will be apparent that the guide means may be of very light weight such that the golf club handles substantially the same with or without the guide properly stroke the club while using the guide means, the golfer may continue employing proper stroking when using a golf club without the guide means.

The invention having been described in detail in accordance with requirements of the Patent Statutes, various other changes and modifications will suggest themselves to those skilled in this art. For example, visible line segments may comprise light beams wherein collimated beams of light are directed along crossing paths, to provide an X-shaped guide, or are emitted obliquely, laterally from a point (such as point 24A in FIG. 1) to provide a V-shaped guide, or are directed along parallel paths originating from opposite ends of the club at equal distances from the sweet-spot. If desired, thin bright colored lines may be painted or otherwise formed on the illustrated guide means longitudinally thereof to provide for line segments of increased visibility. Alternatively, the guide means may comprise a clear transparent sheet supported above the club head upon which line segments are painted, etched, or otherwise formed. In all of the embodiments, the visible line segments comprise straight line segments. Obviously, curved visible line segments may be employed if desired. It is intended that the above and other such changes and modifications shall fall within the spirit and scope of the invention recited in the following claims.

I claim:

1. In combination with a golf club having an upwardly extending shaft and a head at the lower end of the shaft which head includes a bottom surface and a substantially flat ball-striking surface having a sweet-spot, guide means comprising a first pair of relatively unobtrusive, thin, visible line segments which together form at least portions of opposite arms of a V-shape, means for attaching said guide means to the golf club with at least portions of each line segment extending forwardly of the plane of the ball-striking surface and at a height above the bottom surface of the club head that is greater than the diameter of a golf ball to allow striking of the golf ball by the striking surface, said line segments being located at opposite sides of a vertical plane that is normal to the ball-striking surface and extending through the sweet-spot, the spacing between said visible line segments increasing going to the forward free ends thereof, at least a portion of a golf ball at the sweet-spot of the ball-striking surface being visible between the said visible line segments as viewed from above.

2. The combination as defined in claim 1 wherein said means for attaching said guide means to the golf club comprises a bracket attached to the club head intermediate opposite ends thereof to which bracket said pair of line segments are attached.

3. The combination as defined in claim 1 wherein said means for attaching said guide means to the golf club includes brackets attached to the golf club laterally of said vertical plane at equally spaced distances therefrom, and means for attaching said visual line segments to said brackets.

4. The combination as defined in claim 1 wherein said guide means are non-detachably attached to the golf club.

5. The combination as defined in claim 1 wherein said guide means are removably attached to the golf club.

6. The combination as defined in claim 1 wherein said visible line segments comprise straight line segments.

7. The combination as defined in claim 1 including a second pair of visible line segments which together form at least portions of opposite arms of a second V-shape and together with said first pair of visible line segments form an X-shape.

8. The combination as defined in claim 1 wherein said line segments form a V-shape with the point to which the line segments converge being located in said vertical plane at a point therein forward of the plane of the ball-striking surface such that said point directly overlies a golf ball located at the sweet-spot.

9. The combination as defined in claim 1 wherein said line segments form a V-shape with the point to which the line segments converge being located in said vertical plane at a point on the plane of the ball-striking surface.

10. The combination as defined in claim 1 wherein said line segments form a V-shape with the point to which the line segments converge being located in said vertical plane at a point therein rearward of the ball-striking surface.

11. In combination with a golf club having an upwardly extending shaft and a head at the lower end of the shaft which head includes a bottom surface and a substantially flat ball-striking surface having a sweet-spot, guide means comprising a first pair of intersecting visible line segments forming an X-shape, means for attaching said guide means to the golf club with the intersection of the visible line segments located at a point on a vertical plane that is normal to the ball-striking surface of the head at the sweet-spot, at least portions of said line segments extending forwardly of the plane of the ball-striking surface, said guide means being generally horizontally positioned at a height above the bottom surface of the club head that is greater than the diameter of a golf ball to allow striking of the golf ball by the striking surface.

12. The combination as defined in claim 11 wherein said guide means are non-detachably attached to the golf club.

13. The combination as defined in claim 11 wherein said guide means are removably attached to the golf club.

14. The combination as defined in claim 13 wherein said attaching means includes a web extending laterally across the upper face of the club head, and downwardly extending arcuate legs at opposite ends of the web frictionally engagable with opposite ends of the club head for removably securing the guide means to the club head.

15. The combination as defined in claim 11 including a second pair of intersecting visible line segments forming a second X-shape, the intersections of the first and second pairs of visible line segments being substantially co-located, the first and second X-shaped line segments being formed with different angular dimensions.

16. The combination as defined in claim 11 wherein said visible line segments comprise flexible string-like members, and said attaching means comprise brackets adjacent opposite ends of the club head to which said string-like members are attached.

17. The combination as defined in claim 16 wherein said brackets include horizontal line segments that extend forwardly of the striking surface of the club.

18. The combination as defined in claim 11 wherein said line segments are straight.

19. The combination as defined in claim 11 wherein the intersections between said pair of intersecting visible line segments is located in said vertical plane at a point therein forward of the plane of the ball-striking surface such that said intersection overlies a golf ball located at the sweet-spot.

20. The combination as defined in claim 11 wherein the intersection between said pair of intersecting visible line segments is located in said vertical plane at a point therein in the plane of the ball-striking surface.

21. The combination as defined in claim 11 wherein the intersection between said pair of intersecting visible line segments is located in said vertical plane at a point therein rearward of the plane of the ball-striking surface.

* * * * *